US008443739B2

(12) United States Patent
Goff et al.

(10) Patent No.: US 8,443,739 B2
(45) Date of Patent: May 21, 2013

(54) TERTIARY AIR ADDITION TO SOLID WASTE-FIRED FURNACES FOR NOX CONTROL

(75) Inventors: Stephen P. Goff, Allentown, PA (US); Mark L. White, Tannersville, PA (US); Stephen G. Deduck, Scotch Plains, NJ (US); John D. Clark, Goshen, NY (US); Christopher A. Bradley, Elizabethtown, PA (US); Robert L. Barker, Hochessin, DE (US); Zenon Semanyshyn, East Hanover, NJ (US)

(73) Assignee: Covanta Energy Corporation, Fairfield, NJ (US)

( * ) Notice: Subject to any disclaimer, the term of this patent is extended or adjusted under 35 U.S.C. 154(b) by 0 days.

(21) Appl. No.: 13/014,265

(22) Filed: Jan. 26, 2011

(65) Prior Publication Data

US 2011/0117505 A1 May 19, 2011

Related U.S. Application Data

(63) Continuation of application No. 11/905,809, filed on Oct. 4, 2007, now abandoned.

(60) Provisional application No. 60/876,573, filed on Dec. 22, 2006.

(51) Int. Cl.

| | |
|---|---|
| ***F23N 3/06*** | (2006.01) |
| ***F23G 7/00*** | (2006.01) |
| ***F23J 15/00*** | (2006.01) |

(52) U.S. Cl.

USPC ..... 110/191; 110/188; 110/203; 110/235; 110/245

(58) Field of Classification Search

USPC ..... 110/265, 188, 191, 203, 235, 345

See application file for complete search history.

(56) References Cited

U.S. PATENT DOCUMENTS

| | | | |
|---|---|---|---|
| 3,785,304 | A | 1/1974 | Stookey |
| 4,254,715 | A | 3/1981 | LaHaye et al. |
| 4,315,468 | A | 2/1982 | Tyer et al. |
| 4,425,855 | A | 1/1984 | Chadshay |

(Continued)

FOREIGN PATENT DOCUMENTS

| | | | |
|---|---|---|---|
| CN | 1300359 | A | 6/2001 |
| EP | 1 213 534 | A2 | 6/2002 |
| WO | 2005/118113 | A1 | 12/2005 |
| WO | 2006/084954 | A1 | 8/2006 |

OTHER PUBLICATIONS

International Search Report received in corresponding Int'l Appl. No. PCT/US07/25835.

(Continued)

*Primary Examiner* — Kenneth Rinehart
*Assistant Examiner* — David J Laux
(74) *Attorney, Agent, or Firm* — Hogan Lovells US LLP

(57) ABSTRACT

Through the addition of tertiary air and a reduction of secondary air, NOx emissions from a waste-to-energy (WTE) boiler may be reduced. The tertiary air is added to the WTE at a distance from the secondary air, in a boiler region of relatively lower temperatures. A secondary NOx reduction system, such as a selective non-catalytic reduction (SNCR) system using ammonia or urea, may also be added to the boiler with tertiary air to achieve desirable high levels of NOx reductions. The SNCR additives are introduced to the WTE boiler proximate to the tertiary air.

8 Claims, 3 Drawing Sheets

U.S. PATENT DOCUMENTS

| | | | | | |
|---|---|---|---|---|---|
| 5,009,173 | A | * | 4/1991 | Temelli | 110/244 |
| 5,054,405 | A | * | 10/1991 | Walker | 110/254 |
| 5,207,176 | A | | 5/1993 | Morhard et al. | |
| 5,510,092 | A | | 4/1996 | Mansour et al. | |
| 5,720,165 | A | * | 2/1998 | Rizzie et al. | 110/265 |
| 5,809,913 | A | * | 9/1998 | Kramer et al. | 110/347 |
| 5,937,772 | A | | 8/1999 | Khinkis et al. | |
| 6,003,475 | A | * | 12/1999 | Elsner et al. | 110/245 |
| 6,336,415 | B1 | | 1/2002 | Ruegg et al. | |
| 6,764,304 | B2 | | 7/2004 | Atreya | |
| 2003/0079665 | A1 | | 5/2003 | Atreya | |

OTHER PUBLICATIONS

Supplementary European Search Report & Written Opinion for European Appln. No. 07853421.1, dated Oct. 27, 2011.

* cited by examiner

TERTIARY AIR ADDITION TO SOLID WASTE-FIRED FURNACES FOR NOX CONTROL

CROSS REFERENCE TO RELATED APPLICATIONS

This application is a continuation of U.S. patent application Ser. No. 11/905,809, filed Oct. 4, 2007 now abandoned, which claims priority under 35 U.S.C. §119(e) from U.S. Provisional Patent Application Nos. 60/876,573 filed on Dec. 22, 2006, the subject matter of which is herein incorporated by reference.

FIELD OF THE INVENTION

This invention is a process for reducing NOx emissions from a waste-to-energy boiler by the addition of tertiary air and a reduction of secondary air. Embodiments of this process can also be coupled with a secondary NOx reduction system, such as a simple selective non-catalytic reduction (SNCR) system using ammonia or urea, to achieve desirable high levels of NOx reductions.

BACKGROUND OF THE INVENTION

The combustion of solid waste in a Municipal Waste Combustor (MWC) generates some amount of NOx. NOx is the generic name for a group of colorless and odorless but highly reactive gases that contain varying amounts of NO and $NO_2$. The amount of NOx generated by the MWCs varies somewhat according to the grate and furnace design but typically ranges between 250 and 350 ppm (dry value at 7% $O_2$ in the flue gas).

The chemistry of NOx formation is directly tied to reactions between nitrogen and oxygen. To understand NOx formation in a MWC, a basic understanding of combustor design and operation is useful. Combustion air systems in MWCs typically include both primary (also called undergrate) air and secondary (also called overgrate or overfire) air. Primary air is supplied through plenums located under the firing grate and is forced through the grate to sequentially dry (evolve water), devolatilize (evolve volatile hydrocarbons), and burn out (oxidize nonvolatile hydrocarbons) the waste bed. The quantity of primary air is typically adjusted to minimize excess air during initial combustion of the waste while maximizing burnout of carbonaceous materials in the waste bed. Secondary air is injected through airports located above the grate and is used to provide turbulent mixing and destruction of hydrocarbons evolved from the waste bed. Overall excess air levels for a typical MWC are approximately 60 to 100% (160-200% of stoichiometric (i.e., theoretical) air requirements), with primary air typically accounting for 50-70% of the total air.

In addition to destruction of organics, one of the objectives of this combustion approach is to minimize NOx formation. NOx is formed during combustion through two primary mechanisms: Fuel NOx from oxidation of organically bound elemental nitrogen (N) present in the municipal solid waste (MSW) stream and Thermal NOx from high temperature oxidation of atmospheric $N_2$.

More specifically, fuel NOx is formed within the flame zone through reaction of organically bound N in MSW materials and $O_2$. Key variables determining the rate of fuel NOx formation are the availability of $O_2$ within the flame zone, the amount of fuel-bound N, and the chemical structure of the N-containing material. Fuel NOx reactions can occur at relatively low temperatures (<1,100° C. (<2,000° F.)). Depending on the availability of $O_2$ in the flame, the N-containing compounds will react to form either $N_2$ or NOx. When the availability of $O_2$ is low, $N_2$ is the predominant reaction product. If substantial $O_2$ is available, an increased fraction of the fuel-bound N is converted to NOx.

In contrast, thermal NOx is formed in high-temperature flame zones through reactions between $N_2$ and $O_2$ radicals. The key variables determining the rate of thermal NOx formation are temperature, the availability of $O_2$ and $N_2$, and residence time. Because of the high activation energy required, thermal NOx formation does not become significant until flame temperatures reach 1,100° C. (2,000° F.).

However, NOx emissions are generally undesirable and are of environmental significance because of their role as a criteria pollutant, acid gas, and ozone precursor. Direct health concerns of NOx center on the gases' effects on the respiratory system because NOx reacts with ammonia, moisture and other compounds to form nitric acid and related particles that may damage lung tissue. These and other particles produced from NOx penetrate deeply into sensitive parts of the lungs and can cause or worsen potentially fatal respiratory diseases such as emphysema and bronchitis.

In addition, the emissions of NOx pose other environmental concerns. For example, ground-level ozone is formed when NOx and volatile organic compounds (VOCs) react with heat and sunlight. Children, asthmatics, and people who work or exercise outside are susceptible to adverse effects from the ozone, and these effects include lung tissue damage and decreased lung function. Ozone also damages vegetation and reduces crop yields.

Furthermore, the reaction of NOx and sulfur dioxide with other substances in the air to form acids, which fall to earth with rain, fog, snow or dry particles as acid rain. Acid rain damages or deteriorates cars, buildings and monuments, as well as causes lakes and streams to become unsuitable for fish.

In addition, NOx are indirect greenhouse gases that affect the atmospheric amounts of hydroxyl (OH) radicals. Specifically, the breakdown of NOx gases gives rise to increased OH abundance.

Consequently, various laws and regulations have been passed to limit the emissions of NOx from MWCs and other sources. For example, the Unites States Environmental Agency is authorized in 40 C.F.R. Part 60 to monitor and limit NOx from MWCs. Similar rules and regulations to limit NOx emissions likewise exist internationally, such as in Europe, Canada, and Japan. It should be appreciated that a complete understanding and knowledge of various rules and laws on NOx emissions are outside the scope of the current discussion.

NOx control technologies can be divided into two subgroups: combustion controls and post-combustion controls. Combustion controls limit the formation of NOx during the combustion process by reducing the availability of $O_2$ within the flame and lowering combustion zone temperatures. These technologies include staged combustion, low excess air, and flue gas recirculation (FGR). Staged combustion and low excess air reduce the flow of undergrate air in order to reduce $O_2$ availability in the combustion zone, which promotes chemical reduction of some of the NOx formed during primary combustion. In FGR, a portion of the combustor exhaust is returned to the combustion air supply to both lower combustion zone $O_2$ and suppress flame temperatures by reducing the ratio of $O_2$ to inerts ($N_2$ and carbon dioxide ($CO_2$)) in the combustion air system.

Post-combustion controls relate to removing NOx emissions produced during the combustion process at solid waste fired boilers, and the most commonly used post-combustion NOx controls include selective non-catalytic reduction (SNCR) systems, which typically reduce the NOx significantly, or selective catalytic reduction (SCR) systems, which typically reduce the NOx even more effectively than SNCR systems. As described in greater detail below, SCR systems are many times more expensive to build, operate, and maintain than SNCR systems and are consequently not economically feasible for use on waste-to-energy (WTE) plants in many parts of the world.

SCR is an add-on control technology that catalytically promotes the reaction between $NH_3$ and NOx. SCR systems can use aqueous or anhydrous $NH_3$ reagent, with the primary differences being the size of the $NH_3$ vaporization system and the safety requirements. In the SCR system, a precise amount of a reagent is metered into the exhaust stream. The reagent decomposes into ammonia and reacts with NOx across a catalyst located downstream of the injection point. This reaction reduces NOx to elemental nitrogen and water vapor. SCR systems typically operate at temperature of approximately 500-700° F. In terms of waste disposal fee impact and cost effectiveness, SCR generally has higher costs resulting from high capital costs, as well as the cost of catalyst replacement and disposal.

In contrast, SNCR reduces NOx to $N_2$ without the use of catalysts. Similar to the SCR system, the SNCR system injects one or more reducing agents into the upper furnace of the MWC to react with NOx and form $N_2$. Without the assistance of a catalyst, these reactions occur at temperatures of approximately 1600-1800° F. Operation of SNCR processes near the upper end of their performance range may result in unwanted emissions of ammonia or other by-product gases. SNCR generally has significantly lower capital costs, as well as lower maintenance costs since there are no catalysts to replace and dispose.

SUMMARY OF THE INVENTION

This invention is a process where at least a third combustion air stream is added to the solid waste combustion furnace at an elevation significantly above the elevation of the conventional secondary air nozzles. The elevation of this third, or tertiary air stream, is generally at least 10 feet, but optimally 25 to 50 feet above the secondary air nozzles. The tertiary air stream is injected into the furnace through nozzles located on the front, rear, left, or right walls of the furnace, in any number and combination that provides adequate mixing of the tertiary air with the combustion gases.

A portion of the normal secondary air ranging from about 50 to 100% is shifted to this new tertiary air stream. Thereby, the total air flow to the furnace does not have to be increased over that of the conventional design. By then controlling the flow of primary air at or slightly below the stoichiometric amount needed for combustion, the amount of excess oxygen in the region below the tertiary air is minimized, resulting in long lazy flames and reduced NOx formation. The temperature in this region is very close to the adiabatic flame temperature, which is above about 2000° F. and typically near 2500° F.

The reduced excess oxygen in the combustion region below the tertiary air injection also results in higher temperatures which can damage typical furnace construction materials. To minimize this damage, a small amount of secondary air is injected at low velocities to help center the flames away from the furnace walls and also create a cooler air blanket along the walls. Thus, the role of secondary air is generally contrary to its purpose in typical furnace designs, where it is used to create turbulence and good mixing to complete the combustion process.

The tertiary air is then injected higher in the furnace at flow rates and velocities to create high turbulence and complete mixing with the flue gases. This tertiary air stream then completes the combustion process, achieving low levels of carbon monoxide in the flue gas. The flue gas temperature after the injection of the tertiary air is typically between about 1600° F. and 1900° F.

This new combustion set-up may yield NOx levels in the range of about 100 to 190 ppm, thereby achieving the same or lower NOx levels as conventional solid waste fired furnaces with SNCR systems.

Furthermore, with the addition of this new tertiary air stream in the middle to upper furnace regions, conventional SNCR, which employs the injection of ammonia or urea into the combustion gases in the temperature window of 1600° to 1800° F., can be added just above the tertiary air nozzles for optimal performance. The turbulence created by the tertiary air further aids in the mixing of the ammonia or urea with the combustion gases. This enhancement minimizes the number of SNCR nozzles required, reduces the amount of carrier gas needed with the ammonia or urea, and reduces the amount of unreacted ammonia that exits the boiler, which is commonly called ammonia slip. This combination of tertiary air with simple SNCR may yield NOx levels in the range of about 30 to 70 ppm, thereby achieving NOx levels comparable to plants having much more expensive SCR systems.

Thus, in one embodiment of the invention a waste combustion furnace system for reducing NOx emission is provided. The system includes a grate supporting a combusting waste bed; at least one secondary nozzle introducing secondary air downstream from the combusting waste bed; and at least one tertiary nozzle introducing tertiary air. The tertiary nozzle(s) is located at a distance downstream from the secondary nozzles, wherein the flue temperature at the distance is normally less than about 1900° F.

In another embodiment of the invention a method for reducing NOx emission in a waste combustion system is provided. The method involves use of a furnace with a primary air source and a secondary air source for introducing, respectively, primary and secondary airs to a furnace. The method includes the steps of allocating a portion of the primary and secondary airs as tertiary air; and supplying the tertiary air to the furnace air at a distance downstream from the secondary air, wherein the tertiary air reduces Oxygen levels in the furnace upstream of the tertiary air addition.

BRIEF DESCRIPTION OF THE DRAWINGS

A more complete understanding of the present invention and advantages thereof may be acquired by referring to the following description taken in conjunction with the accompanying drawings in which like reference numbers indicate like features, and wherein.

DETAILED DESCRIPTION OF THE PREFERRED EMBODIMENTS

Figure 1:
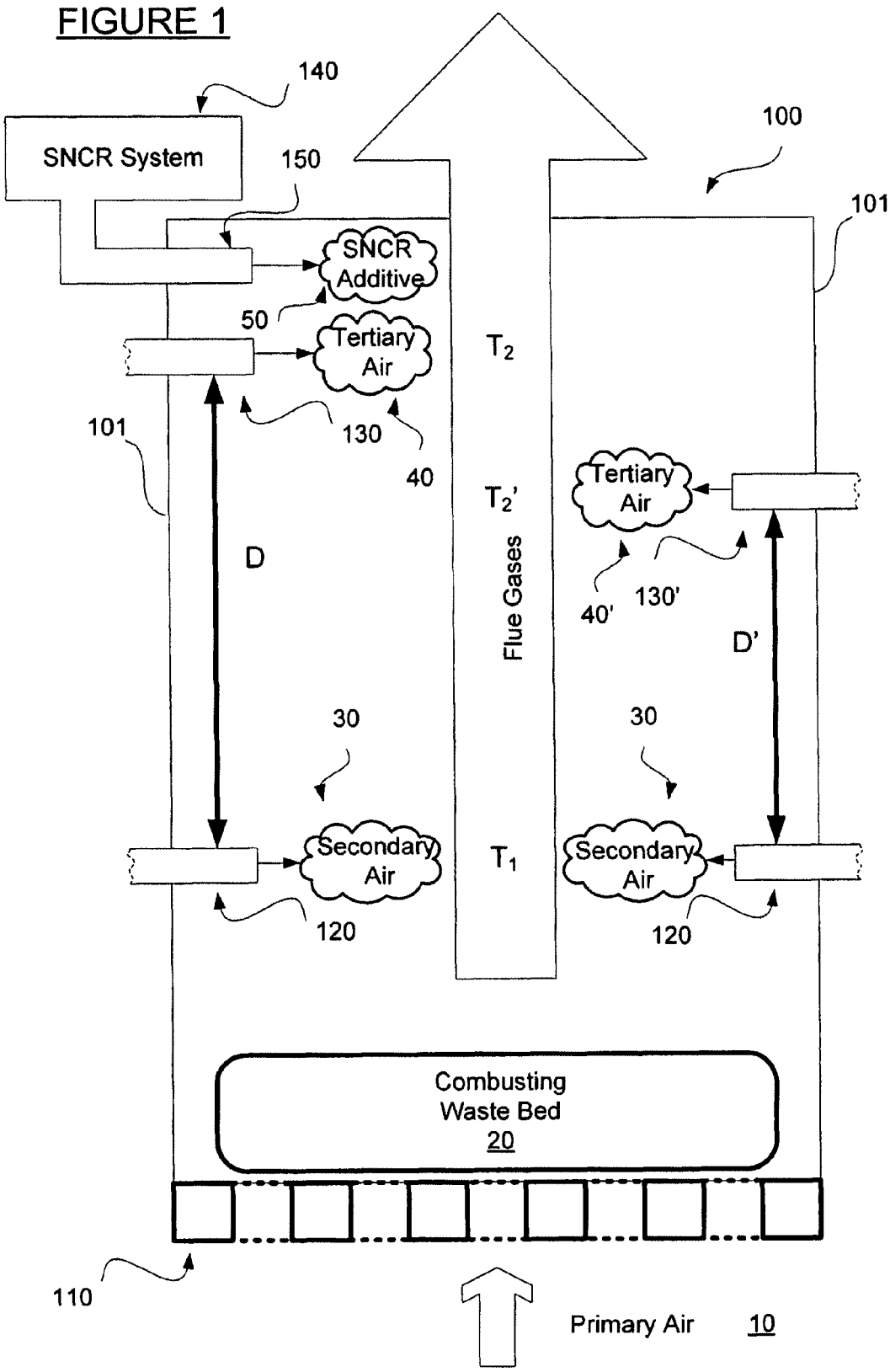
FIGS. 1-2 are schematic diagrams of a municipal waste combustion furnace with additional tertiary air in accordance with embodiments of the present invention.

Referring now to FIG. 1, a solid waste combustion system 100 in one embodiment of the present invention employs a moving grate 110 with three major sources of combustion air. Primary air 10 is introduced below the grate 110 and flows up through a combusting waste bed 20. Secondary air 30 is introduced through one or more rows of secondary nozzles 120 above the combusting waste bed 20. In a typical MWC, the purpose of the secondary air 30 is to complete the combustion of volatile organics and carbon monoxide as soon as possible by adding additional oxygen and providing turbulence to intensely mix the combustion gases. In the present invention the secondary air plays a different role. It is injected at low velocities to minimize mixing and combustion. Its role is to help center the flames in the furnace and create a cooler air blanket along the walls to minimize the impact of the higher furnace temperatures on the materials used to protect the waterwalls of the furnace.

While the present discussion focuses on inclined and horizontal grate-based furnaces, it should be appreciated that the tertiary air NOx reduction principals of the present invention may likewise apply to any solid fuel fired boiler design.

It should be appreciated that the number and location of the secondary air nozzles 120 may vary with different furnace designs but are typically located just above the combusting waste in the lower furnace to accomplish the above-described purpose for the secondary air 30. Furthermore, it should be appreciated that the secondary air nozzles 120 may be adapted or otherwise modified according to known techniques to improve the performance of the furnace 100, for example, by modifying the shape, angle, and position of the secondary air nozzles 120. Although typically placed on the front and rear walls of the furnace, the secondary air nozzles may also be placed on the right and left walls at approximately the same elevation to further accomplish the above-described purpose. Likewise, although not depicted, the furnace 100 may be further modified through the addition and positioning of various shaping elements as needed to direct the flue exhaust flow to optimize the performance of the furnace 100.

Continuing with FIG. 1, the furnace 100 further includes tertiary air nozzles 130 to add a third combustion air stream, or tertiary air 40 to the solid waste combustion furnace. The tertiary air stream may be injected into the furnace 100 through the tertiary nozzles 130 located on the front, rear, left, or right walls of the furnace 100, in any number and combination that provides adequate mixing of the tertiary air with the combustion gases for the purpose of completing the combustion process and achieving low levels of carbon monoxide in the flue gas. It should be appreciated that the number and location of the tertiary air nozzles 130 may vary with different furnace designs but are typically located at an elevation significantly above the elevation of the secondary air nozzles 120. Furthermore, it should be appreciated that the tertiary air nozzles 130 may be adapted or otherwise modified according to known techniques to improve the performance of the furnace 100.

Referring back to FIG. 1, the tertiary air nozzles 130 supplying the third, or tertiary, air stream 40 are located a distance D away from the secondary air nozzles 120. The distance D is generally at least 10 feet, but optimally 25 to 50 feet above the secondary air nozzles 120, and the rationale for the spacing is described in greater detail below. In particular, the tertiary nozzles 130 should be positioned sufficiently high to yield minimum NOx formation, but not higher than necessary such that the conditions would cause accelerated wastage to excessively large areas of the furnace wall materials. The precise location of the tertiary nozzles 130 at the distance D above the secondary air nozzles 120 will depend on numerous factors such as the specific configuration, size, and design of the furnace 100, along with the specific chemical nature of the combusting waste bed 20.

In particular, the secondary air 30 is typically introduced at a portion of the furnace 100 proximate to the combusting waste bed, and the temperature T1 in this location is relatively high, and is at or near the adiabatic temperature for the combustion of the waste fuel. Because the tertiary air 40 is introduced at a higher elevation, this portion of the furnace 100 is at a relatively lower temperature T2. For example, the temperature T1 would be above 2000° F. and typically at approximately 2500° F., and the temperature T2 may be between approximately 1600° and 1900° F. at the tertiary injection level (after the addition of the tertiary air) because of heat transfer to the furnace walls and mixing of the cooler tertiary air with the hot flue gas.

Reduction of the secondary air introduced at a higher temperature T1, and the addition of the tertiary air 40 at a lower temperature T2 results in lower NOx for two reasons. First, substoichiometric or nearly stoichiometric conditions exist between the secondary and tertiary nozzles, reducing the amount of excess oxygen available for reaction with nitrogen to form NOx. In addition, some portion of the NOx formed during primary combustion at the grate level will be chemically reduced within the region between the secondary and tertiary nozzles by NH2 and HCN radicals formed due to the lack of excess air. Second, exhaust combustion continues in the furnace 100 at the lower temperature T2, after the addition of the tertiary air, while the NOx production at this temperature is minimized. In test applications, a MWC configured to introduce secondary air 30 at a high temperature T1 and tertiary air 40 at lower temperature T2 yields lower NOx levels in the range of about 130 to 180 ppm, thereby achieving the same NOx levels as conventional solid waste fired furnaces with SNCR systems.

While the tertiary air 40 is typically injected at one elevation in the boiler 100 due to the cost of installing the nozzles 130 and duct work (not depicted), it would be possible to inject the tertiary air 40 in more than one elevation D, either to improve mixing with the flue gas, or to enable the elevation to be changed as the boiler fouls and the flue gas temperature profile through the boiler changes. Therefore, continuing with FIG. 1, one embodiment of the furnace 100 may further contain additional tertiary air nozzles 130' supplying an additional tertiary air stream 40' are located a second distance D' above from the secondary air nozzles 120. Because the additional tertiary air nozzles 130' is located at a different elevation D', the additional tertiary air stream 40' is introduced in a portion of the furnace 100 having a different temperature T2'.

Continuing with FIG. 1, the furnace 100 may achieve additional NOx reduction through the incorporation of an additional NOx reduction technology. For example, FIG. 1 depicts the incorporation of a known SNCR system 140 into the furnace 100. In particular, the SNCR system 140 typically injects a SNCR additive 50 such as ammonia or urea into the combustion gases in a temperature range of 1600° to 1800° F. Since, as described above, this temperature range is achieved in the middle to upper portion of the furnace 100 near the addition of the tertiary air stream 40, SNCR nozzles 150 may be positioned above the tertiary air nozzles 130 for optimal performance.

Furthermore, turbulence in the furnace created by the tertiary air 40 further aids in the mixing of the SNCR additive 50 with the combustion gases. This enhancement minimizes the number of SNCR nozzles 150 required, reduces the amount of carrier fluid needed with the SNCR additive 50, and reduces the amount of unreacted ammonia that exits the boiler, which is commonly called ammonia slip.

In experiments, this combination of tertiary air 40 with a SNCR system 140 yields NOx levels generally in the range of 30 to 70 ppm, thereby achieving NOx levels comparable to plants having much more expensive SCR systems.

While the embodiment of the furnace 100 depicted in FIG. 1 includes a SNCR system, it should be appreciated that still further NOx reductions may be achieved by incorporating a SCR system with a furnace 100 supplying tertiary air 40. In this situation where a non-SNCR NOx reduction system is employed, the tertiary air nozzles 130 can be adapted as needed to optimally apply the specific NOx reduction system. For example, as described above, the SCR systems use a catalyst that allows the NOx reducing reactions to occur at relatively lower temperatures in comparison to SNCR systems, approximately in the range of 500-700° F. Accordingly, the tertiary air nozzles 130 may be moved to a greater distance D away from the secondary air nozzles so that the flue temperature T2 is less than the 1600-1800° F. range described above.

Figure 2:
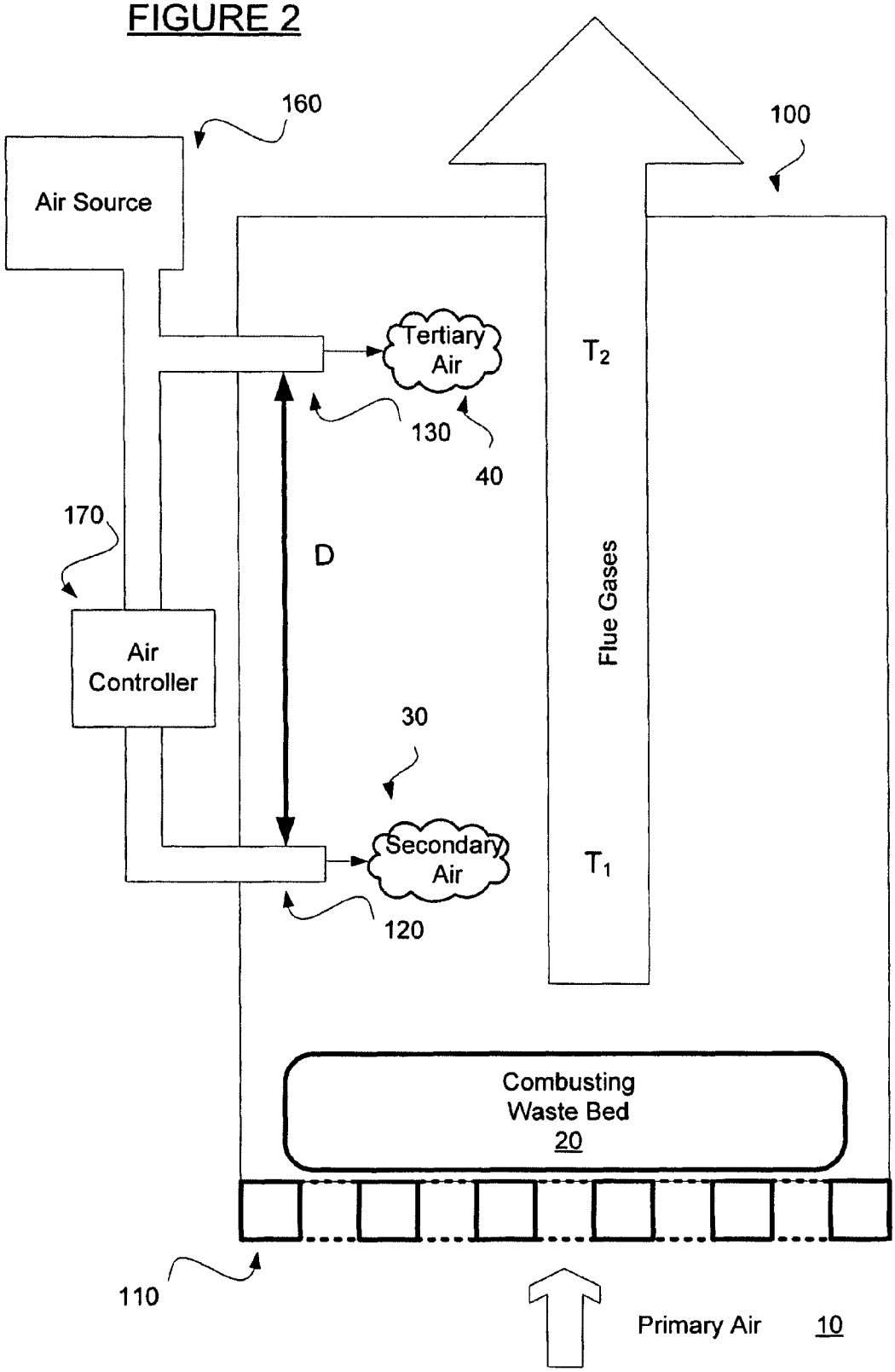

Referring now to FIG. 2, the furnace 100 in accordance of an embodiment of the present invention further comprises an air source 160 such as a motorized fan or other known air circulation system. In the depicted embodiment, a single air source 160 supplies both the secondary air 30 and the tertiary air 40. It should be appreciated however, that each of these inputs to the furnace 100 may be separately supplied and that this depicted configuration is merely for ease of illustration. It should also be appreciated that the primary air 10 is typically supplied to a MWC separately due to different pressure requirements, however, it would also be possible to provide all three air streams, primary 10, secondary 30 and tertiary 40 from a single source.

As described above, the total amount of air provided to a MWC, such as the furnace 100, is engineered to accomplish various combustion goals. Accordingly, the total amount of air provided to the furnace 100 through the primary air 10, secondary air 30, and tertiary air 40 does not necessarily change significantly from the total amount of primary air and secondary air supplied in known MWC systems. For similar reasons, the amount of primary air 10 provided in the furnace 100 does not generally change from the total amount of primary air supplied in known MWC systems. Thus, one preferred implementation of the present invention diverts a portion of the secondary air away from the secondary nozzle 120 and directs this portion as tertiary air 40 to the tertiary nozzle 130. Consequently, the amount of tertiary air 40 supplied to the furnace 100 has a corresponding reduction in the amount of secondary air 30. In one embodiment, 50 to 1000 of the normal secondary air 30 is shifted to the tertiary nozzle 130 as tertiary air 40, and thereby the total air flow to the furnace 100 is similar to conventional designs.

It should be appreciated that different boiler designs utilize different primary and secondary air flows 10 and 30 and ratios of primary to secondary air 10 and 30. Therefore, the present invention could be applied to any boiler designs by shifting all, or a significant fraction of the secondary air 30 to the tertiary air nozzles 130. In addition, a fraction of the primary air 10 could also potentially be shifted to the tertiary air nozzles 130.

With the addition of tertiary air 40, the role changes for the reduced secondary air 30. As explained above, the secondary air 30 in known MWCs creates high turbulence with the flue gas, providing the mixing necessary to complete the combustion. With the addition of tertiary air 40, any remaining secondary air 30 does not generally provide good mixing. Instead, the secondary air 30 enters the furnace 100 at a much lower velocity and stays close to the walls 101 of the furnace 100, helping to protect the walls 101 from any increased temperatures and higher flames.

By then controlling the combined flow of the primary air 10, secondary air 30, and the tertiary air 40, the temperature of the combustion gases between the secondary air injection and the new tertiary air injection can be controlled to an optimal level. Continuing with FIG. 2, a controller 170 may adjust the allocation of air supplied as secondary air 30 and tertiary air 40. For example, the controller 170 may operate a damper that dynamically adjusts to open and close, according to the measured temperatures T1 and T2 in the furnace 100. Likewise, the air source 160 and/or a primary air source (not illustrated) can be adjusted as needed to achieve desired temperatures. The controller 170 may receive input measurements and adjust the allocation of the secondary air 30 and the tertiary air 40 as needed for desired system performance. For example, the controller 170 may be connected to a known Continuous Emissions Monitoring (CEM) system (not illustrated) that monitors the emissions within and from the furnace system. The controller 170, for example may adjust the allocation of the secondary air 30 and the tertiary air 40 as needed to minimize NOx emissions, for example to achieve desired temperature ranges for a SNCR or similar system, to achieve desired turbulence levels, to achieve desired Oxygen levels, etc.

Continuing with FIG. 2, it should likewise be appreciated that the primary, secondary, and tertiary airflows 10, 30, and 40 may be adjusted to achieve other performance measures. In particular, while the above discussion mentions adjusting the amount and allocation of the primary air 10, secondary air 30, and the tertiary air 40 to achieve desired thermal levels in specific regions of the furnace 100, similar techniques may be used to achieve other desired criteria. For example, the amount and allocation of the primary air 10, secondary air 30, and the tertiary air 40 may be adjusted so that the exhaust resides in the furnace 100 for a desired amount of time or is otherwise controlled to achieved desired performance such as boiler fouling or boiler efficiency. Additionally, the amount of tertiary air 40 may be controlled to achieve a desired level of turbulence and performance of the SNCR additive 150 (from FIG. 1) as previously described.

Figure 3:
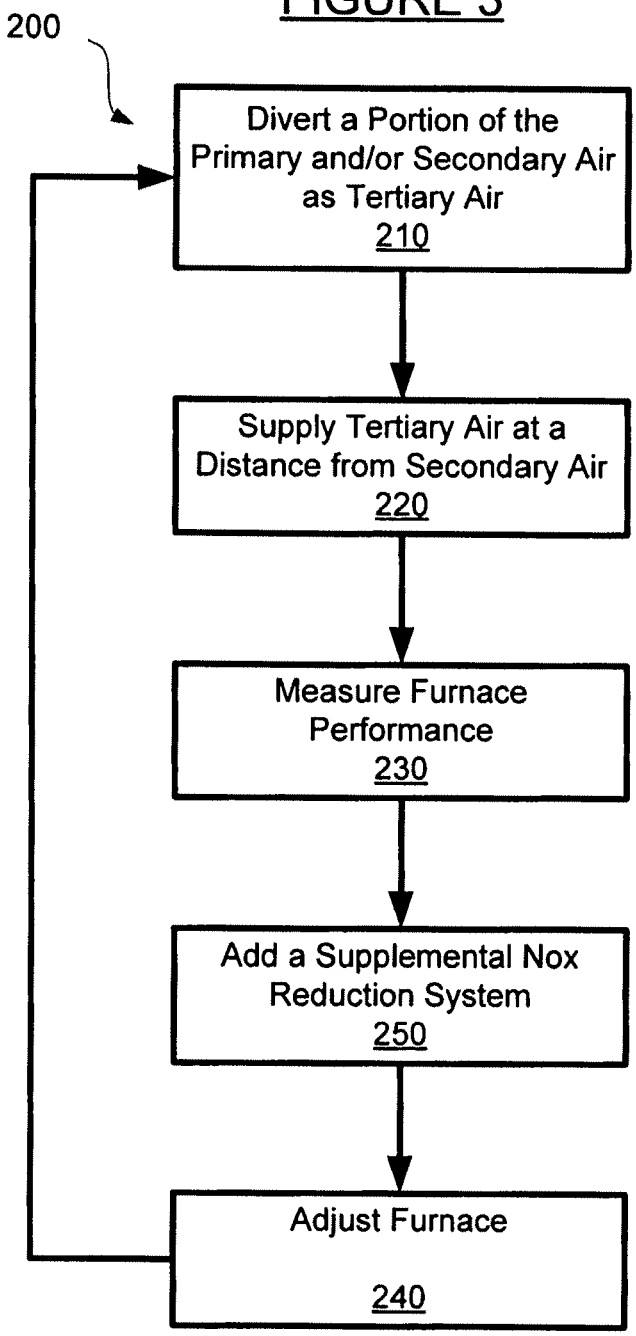
FIG. 3 is a flow chart depicting the steps in method for reducing NOx emissions from a municipal waste combustor through the use of a tertiary air source in accordance with embodiments of the present invention.

Referring now to FIG. 3, a NOx reduction method 200 for adapting a known MWC facility having a primary and secondary air source in accordance with an embodiment of the present invention is now discussed. In particular, the NOx reduction method 200 includes diverting a portion of the primary and/or secondary air as tertiary air, step 210. As described above, a damper may be used to redirect a portion of the secondary air. Alternatively, the mechanism supplying the secondary air may operate at a reduced level, and a second mechanism may be used to supply the tertiary air. While it is generally assumed that the overall amount of air supplied to the furnace will not increase, it should be appreciated that the air supply may be adapted as needed to achieve desired further performance. As described above, different boiler designs utilize different primary and secondary air flows and ratios of primary to secondary air. The idea could be applied to any of these boiler designs by shifting all, or a significant fraction of the secondary air to the new tertiary air nozzles. In addition, a fraction of the primary air could also potentially be shifted to the new tertiary air nozzles.

Continuing with the NOx reduction method 200 in FIG. 3, the tertiary air is introduced into the furnace at a distance away from the secondary air, step 220. As described above, the tertiary air is generally introduced at one or more higher elevations in a furnace region of relatively lower temperature. The temperature in this chosen furnace region should be sufficiently high to allow the combustion process to continue but sufficiently low to minimize NOx production.

Continuing with the NOx reduction method 200 in FIG. 3, the furnace is measured in step 230 to determine if desired performance measures are achieved. For example, the temperature in different regions of the furnace may be measured. As described above, different furnace performance measures, such as exhaust dwell time, NOx production levels, or the production levels of other pollutants, may also be used in evaluating the performance of the tertiary air. The evaluation in the furnace measurement step 230 may occur continuously or periodically, depending on desired performance and available resources.

Continuing with Step 230, while there is no direct measurement of stoichiometric conditions, by using ongoing measurements of air flows and excess O2 levels in the flue gas, the approximate stoichiometric air flow can be determined. Another way to look at it is that the furnace is very large and there are regions with excess air, and other regions with no excess air. When operating with the tertiary air, a much higher fraction of the furnace will have no excess air, so the furnace will have corresponding low O2 levels.

Referring back to the NOx reduction method 200 in FIG. 3, the results from the furnace measurement step 230 may be used to adjust the furnace in step 240, such as modifying the step of diverting the portion of the primary and/or secondary air as tertiary air in step 210. Otherwise, the MWC may be adjusted by modifying the amounts of primary air, secondary air, and tertiary air. The furnace adjustment in step 240 may similarly occur to react to changes in the municipal waste supplied to the MWC.

Returning to the NOx reduction method 200 in FIG. 3, supplement NOx reduction methods, such as SCR or SNCR, may also optionally be added to a MWC in step 250 to further reduce NOx emissions in coordination with the addition of the tertiary air. For example, data from MWCs using NOx reduction methods according to embodiments of the present invention is shown below.

Table 1 provides sample data from a MWC using a NOx reduction method according to an embodiment of the present invention for various timed periods. For the results shown in Table 1, supplemental NOx reduction methods, such as SCR or SNCR, were not used. As shown in Table 1, NOx values were measured to vary from 100 ppm to 190 ppm as the ratio of secondary air to tertiary air is varied from about 0.4 to 1.5. These values are measurably lower than typical amounts of NOx generated by MWCs (typically between 250 and 350 ppm).

TABLE 1

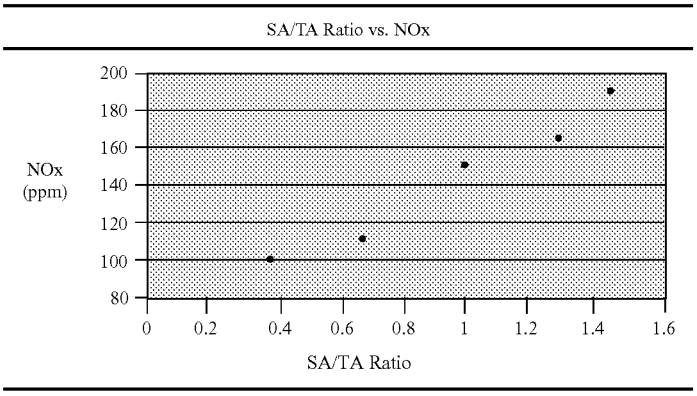

Table 2 provides sample data from a MWC using a NOx reduction method with supplemental SNCR according to another embodiment of the present invention for various timed periods. As shown in the "NOx" column of Table 2, NOx values were measured between 50 and 62 ppm, NOx values were measurably lower than NOx amounts generated by MWCs using NOx reduction techniques according to an embodiment of the present invention without supplement NOx reduction methods (shown in FIG. 1). In fact, the measured values compare favorably with more expensive SCR techniques.

TABLE 2

| Case | Days | Steam Klh/hr | Aq. NH3 gph | NOx ppm | $NH_3$ Slip ppm |
|---|---|---|---|---|---|
| 1 | 4 | 78 | 9.3 | 62 | 1.2 |
| 2 | 10 | 78 | 12.6 | 62 | 2.4 |
| 3 | 14 | 76 | 13.0 | 59 | 4.8 |
| 4 | 3 | 75 | 12.5 | 50 | 2.5 |

CONCLUSION

While the invention has been described with reference to an exemplary embodiments various additions, deletions, substitutions, or other modifications may be made without departing from the spirit or scope of the invention. Accordingly, the invention is not to be considered as limited by the foregoing description, but is only limited by the scope of the appended claims.

What is claimed is:

1. A waste combustion system for reducing NOx emission, the system comprising:

a furnace, said furnace comprising a grate supporting a combusting waste bed, a primary air source introducing primary air upstream from the grate, at least one secondary nozzle introducing secondary air downstream from the combusting waste bed, and at least one tertiary nozzle introducing tertiary air, the at least one tertiary nozzle located at a distance downstream from said at least one secondary nozzle;

a continuous emissions monitoring system configured to monitor NOx emissions from the furnace;

a controller configured to receive measurements from the continuous emissions monitoring system and to dynamically adjust the allocation of the secondary air and the tertiary air in response to said measurements so as to reduce the NOx emissions from the furnace, while simultaneously minimizing thermal degradation of a wall of the furnace, wherein the secondary air enters the furnace system at a velocity such that it causes only negligible mixing in the furnace;

a selective non-catalytic reduction (SNCR) system, the SNCR system comprising at least one SNCR nozzle configured to inject a reagent into the furnace, said at least one SNCR nozzle positioned downstream from the at least one tertiary air nozzle;

wherein the at least one SNCR nozzle is located within a turbulence zone generated by the at least one tertiary air nozzle to improve the mixing and reaction effectiveness of the reagent introduced by the SNCR system; and wherein the controller is further configured to dynamically adjust the allocation of the secondary air and the tertiary air so as to improve effectiveness of the reagent introduced by the SNCR system.

2. The system of claim 1, wherein the temperature near the at least one tertiary nozzle is less than about 2000° F.

3. The system of claim 1, wherein the controller is further configured to dynamically adjust the allocation of the primary air to the primary air source.

4. The system of claim 1, wherein the controller is further configured to dynamically adjust the amounts of the secondary air and the tertiary air to minimize Oxygen levels in the furnace upstream of the at least one tertiary air nozzle.

5. The system of claim 1, wherein the secondary air stays close to a wall of the furnace to protect the wall from high temperatures.

6. The system of claim 1, wherein the temperature near the at least one secondary nozzle is from about 2000° F. to about 2500° F.

7. The system of claim 1, wherein the oxygen concentration between the at least one secondary nozzle and the at least one tertiary nozzle is nearly stoichiometric.

8. The system of claim 1, wherein an amount of air present between the at least one secondary nozzle and the at least one tertiary nozzle exceeds stoichiometric conditions by about 10% to about 30%.

* * * * *